United States Patent [19]

LeVine

[11] 4,261,122

[45] Apr. 14, 1981

[54] STORAGE AND SECURITY FRAME ASSEMBLY

[76] Inventor: David E. LeVine, 1276 N. Crescent Heights Blvd., Los Angeles, Calif. 90046

[21] Appl. No.: 49,058

[22] Filed: Jun. 18, 1979

[51] Int. Cl.[3] ..... G09F 1/12

[52] U.S. Cl. ..... 40/152; 40/155; 248/551; 312/204; 312/245

[58] Field of Search ..... 40/155, 152, 152.1, 40/156, 154, 605, 606, 159; 312/204, 226, 245; 248/206 A, 551; 292/251.5

[56] References Cited

U.S. PATENT DOCUMENTS

| | | | |
|---|---|---|---|
| 214,105 | 4/1879 | Cole | 40/155 |
| 2,785,490 | 3/1957 | Fabry | 40/152 X |
| 2,839,857 | 6/1958 | Teller | 40/152 X |
| 3,108,346 | 10/1963 | Bey | 292/251.5 X |
| 3,758,262 | 9/1973 | Harris | 292/251.5 |
| 3,926,488 | 12/1975 | Amos | 312/204 |
| 3,994,087 | 11/1976 | Koeppen | 40/152 |

*Primary Examiner*—John F. Pitrelli
*Attorney, Agent, or Firm*—Howard Sandler

[57] ABSTRACT

A storage and security frame assembly and more particularly a storage and security frame assembly including a multi-sided polygonal frame comprising respective frame members abutting adjacent frame members at mitered joints and wherein one of the frame members is magnetically retained in the closed position thereof to form the polygonal frame.

15 Claims, 7 Drawing Figures

STORAGE AND SECURITY FRAME ASSEMBLY

BACKGROUND OF THE INVENTION

Typically picture frames are constructed of four frame or molded members which are connected together at respective axial ends thereof at miter joints. The display picture and, if desired, a backing and a facing glass is inserted within the frame rabbet and thereafter, the assembly is sealed and wall hung or easel displayed. Thus, prior picture frame assemblies were primarily for esthetics and generally served no other practical purpose.

Nevertheless, on occasion security minded individuals have been known to slit the backing of such prior picture frame assemblies and insert valuables, or the like, in anticipation that a thief "would never think of looking there". Unfortunately for such security minded individuals an experienced thief or investigator would immediately remove the picture frames and inspect or feel for bulges which are indicative of the hidden treasure-trove. An additional problem which was apparent in attempting to utilize such prior picture frame assemblies for security purposes was the lack of ready accessibility to the hidden objects as well as the relatively small volume of storage space which was offered thereby.

A still further drawback of displaying ones photographs and art with such prior picture frame assemblies was that inasmuch as they occupied such a substantial porition of wall space, they subtracted from the available area in which to inconspicuously store other photographs, art works, papers and the like yet still maintain these articles in a relatively dust free environment and with prompt accessibility. Still further, because such prior picture frame assemblies had the display item therein often sealed from the external environment it was generally a time consuming job, with an inherent risk of damaging the display item during the performance of the multiplicity of steps involved, when it was desired to change the displayed art or photograph. An individual's desire to change the display items but still retain the existing picture frame assembly may arise for enumerable reasons; for example, a change in color schemes and coordination, a change in elected officials, a visit by in-laws who have a desire to see their photgraph on the family portrait wall; and the like.

SUMMARY OF THE INVENTION

By means of a storage and security frame assembly of the present invention, the above-mentioned problems of prior picture frame assemblies are overcome or, in the least, greatly alleviated. Specifically, the invention herein includes a frame assembly wherein the frame members, in conjuction with a backing, provide a spacing for storage of articles therewithin. One of the frame members is retained in the normal closed position thereof by hidden magnetic means and is pivotal to an open position to reveal the interior storage space, as well as to provide easy accessibility to the item being displayed, when the bias of the magnetic means is overcome. The axial ends of the pivotal frame member are mitered in a complementary angle to the adjacent fixed frame members to give the appearance of a totally rigid frame assembly to the unaware.

An additional advantage of the invention herein is the fact that a multi-slotted interior periphery may be utilized for the secure storage of a plurality of articles, for example, record albums, and a particularly attractive or meaningful album cover may be positioned at the display face thereof for a unique and practical wall hanging arrangement. Still further, smaller desk size storage and security frame arrangements may be utilized to serve the dual purpose of displaying items such as business cards, small photographs or small works of art, while still maintaining a readily accessible and relatively concealed storage area for holding items such as petty cash, stamps, pens and the like.

Still further, the invention herein is structured in a fashion for retrofit applications, if desired, with any standard picture frame molding. Thus, the invention herein may be used to convert typical prior art picture frame arrangements into storage and security frame assemblies constructed in accordance with the principles of the present invention.

These and other advantages of the present invention will become more readily apparent upon a reading of the following description and drawings in which:

DETAILED DESCRIPTION

Figure 1:
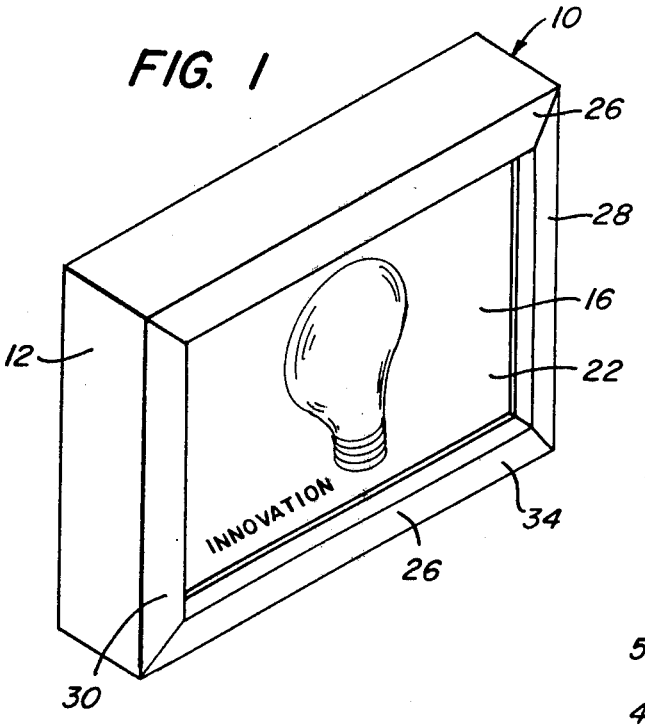
FIG. 1 is an orthographic side view of a security and storage frame assembly constructed in accordance with the principles of the present invention.
Figure 3:
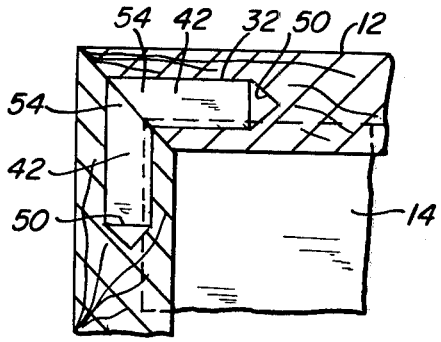
FIG. 3 is a partial cross-sectional view taken on Lines 3—3 of FIG. 2 and which illustrates a corner detail of the frame assembly of FIG. 2 with the pivotal frame member thereof in the closed position and which also more clearly illustrates the mitered magnetic latch means.
Figure 2:
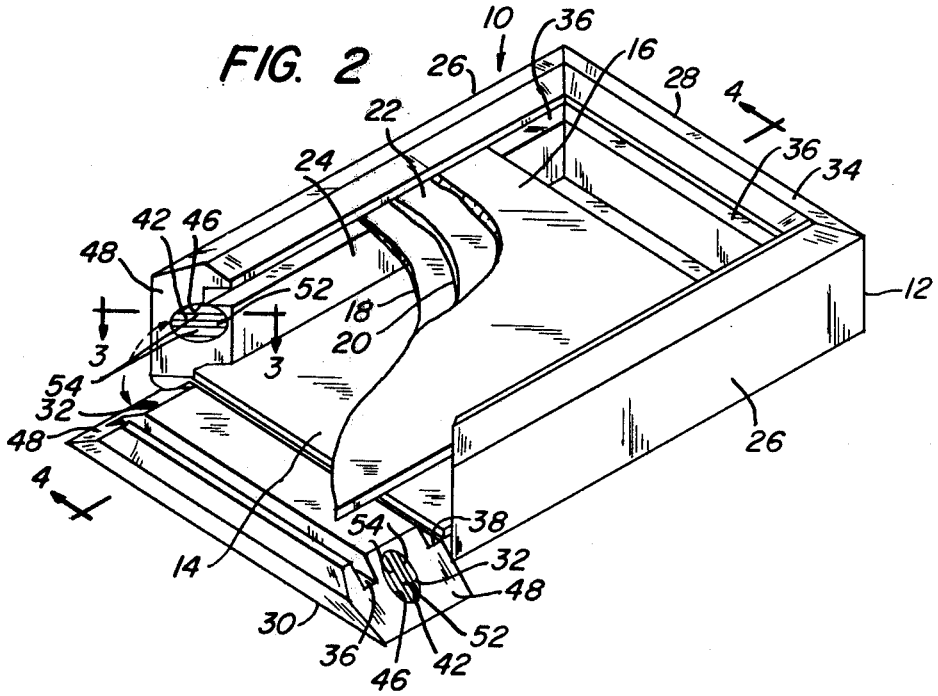
FIG. 2 is an orthographic plan view, partially in section, of the storage and security frame assembly of FIG. 1 wherein a pivotal side member is opened to illustrate the inner periphery thereof.

Referring to FIGS. 1 through 4 there is illustrated a storage and security frame assembly 10 of the present invention which comprises: a polygonal frame member subassembly 12; a generally planar frame backing member 14 which is carried by subassembly 12 adjacent the lower or bottom side thereof; and a planar display window 16 of transparent glass, plastic or the like which is captively retained by sub-assembly 12 adjacent the upper or display side thereof. As best shown in FIG. 2, assembly 10 additionally includes a planar picture backing member 18 which cooperates with display window 16 to sandwich an artwork 20, photograph or the like therebetween such that a display assembly 22 comprising window 16, artwork 20 and backing member 18 are captively retained by subassembly 12. The storage and security frame assembly 10 also includes an internal storage chamber 24 which is defined by the adjacent inner peripheral surfaces of frame member sub-assembly 12, frame backing member 14 and picture backing member 18.

Frame member subassembly 12, as illustrated, has a generally rectangular configuration and comprises a pair of transversely spaced elongated long side members 26 with a pair of longitudinally spaced elongated short side members 28 and 30 extending therebetween. Each of the side members 26, 28 and 30 have the respective axial ends thereof formed as a 45 degree miter such that ends of abutting side members form a miter joint. In final assembly, the miter joints at the short side member 28 with the long side members 26 are fixed. Short side member 30 is pivotal with respect to side members 26 and 28 in a manner as described hereinafter in detail and is releasably retained in the closed position thereof, wherein the miter joints between members 26 and 30 are formed, by respective magnetic latch means 32.

Each of the side members 26, 28 and 30 have the upper portion 34 thereof formed in a decorative molding configuration for obvious aesthetic reasons. Downwardly adjacent portion 34 continuous longitudinally extending grooves 36 are formed within the inner periphery of side members 26, 28 and 30. When side member 30 is pivoted to the closed position thereof, the grooves 36 of all members 26, 28 and 30 lie in a common plane and thus form a generally rectangular receiving means for the releasable retention and support of the respective edges of display assembly 22 therewithin. As is best illustrated in FIG. 2, when side member 30 is pivoted into the open position thereof, display assembly 22 may be easily slid out of frame assembly 10 to change artwork 20.

The side members 26, 28 and 30 each have an inwardly facing continuous longitudinally extending rabbet groove 38 cut in the inner peripheral walls thereof adjacent the bottom surface thereof. Rabbet grooves 38 are dimensioned and oriented such that the adjacent edges of backing member 18 are received therewithin in a manner that the lowermost surface of member 18 lies in a common plane with the lowermost surface of side members 26, 28 and 30. Backing member 18 is retained within grooves 38 in any suitable manner, for example, by nailing or by gluing the edge portions of member 18 to the downwardly facing portion of the rabbet grooves 38 of side members 26 and 28. To permit the pivoting of side member 30, member 18 is not fixed within groove 38 of member 30 but is received therewithin when member 30 is in the closed position thereof.

Figure 4:
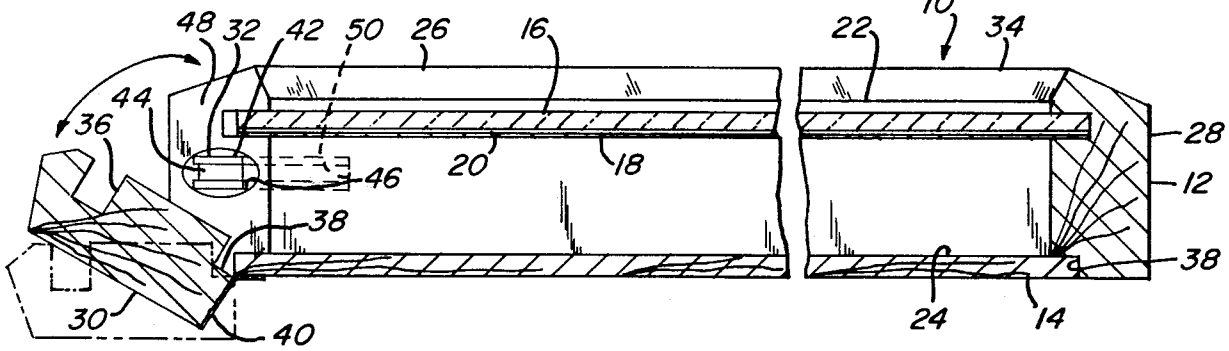
FIG. 4 is a longitudinal cross-sectional view taken on Lines 4—4 of FIG. 2.

Short side member 30 is rendered pivotal about the lowermost end of rabbet groove 38 in any suitable manner; for example, as shown in FIG. 4, a continuously extending ribbon hinge 40 is secured to adjacent bottom surfaces of side member 30 and frame backing member 14. The hinge 40 may be of any suitable material; for example, a multi-filament polyester, leather, fabric or the like. Ribbon hinge 40 is also secured to the adjacent bottom surfaces of members 30 and 14 in any suitable manner, such as with the utilizaton of an epoxy glue. If desired, the entire bottom surface of frame assembly 10 may be coated or covered with a finishing felt or flocking material to thereby serve a tri-purpose of: (1) presenting a frame assembly which would be well finished and extremely attractive from an aesthetic standpoint; (2) providing a soft contact surface to prevent marring or scratching of an adjacent surface of which frame assembly 10 engages; and (3) covering the ribbon hinge 40 such that in a casual glance, an uninformed individual would be unaware of the fact that the short side member 30 may be pivoted outwardly to reveal the internal storage chamber 24. Still further, it is to be understood, that if desired the ribbon hinge 40 may be dispensed with and in lieu thereof, the pivoting of member 30 would still be provided if a continuous planer flexible bottom cover is provided such as is illustrated in FIG. 6.

Each of the magnetic latch means 32 comprise a pair of latch portions 42 which have one end surface 44 thereof mitered at a suitable angle, in the example illustrated at a 45 degree miter. Blind bores 46 are drilled within the adjacent mitered surfaces 48 of side members 26 and 30, parallel to the respective inner and outer edges thereof. Bores 46 are of a diameter and depth such that a latch portion 42 may be press fitted into each bore 46 and when portion 42 engages the blind end 50 of bore 46, the miter surfaces 44 are substantially coplanar with the miter surfaces 48 of the respective side members 26 and 30. It is to be noted that the utilization of a mitered surface 44, which thus provides a magnetic miter joint at the juncture of adjacent latch portions 42, is far superior insofar as magnetic joint strength in comparison to an arrangement of providing a normal pole to pole assembly. Furthermore, such a mitered arrangement for latch means 32 is more easily concealed and will result in a consistent appearance that the miter joints at members 26 and 30 are permanent. A further point to be noted is that the magnetic latch means 32 are located upwardly from the bottom surface of members 26 and 30. This location will result in the necessity to apply a more significant force to overcome the magnetic bias of latch means 32 for the moment arm of the opening force (which is applied at the top of member 30) is reduced from the moment arm which would exist if a latch means 32 were adjacent the bottom of members 26 and 30. Thus, in the preferred embodiments of this invention, the magnetic latch means 32 will be spaced upwardly at least $\frac{1}{3}$ of the depth of the assembly 10 and preferably, at least $\frac{1}{2}$ of such depth.

The latch portions 32 may be of any suitable construction and, as illustrated, include an inner member 52 of elastomer which is impregnated with material having magnetic characteristics. Inner member 52 is sandwiched between and magnetizes a parallel pair of metallic intensifiers 54. When the miter joint between adjacent latch portions 32 is formed, it is actually the mitered surfaces of intensifiers 54 that are in magnetic engagement.

Figure 5:
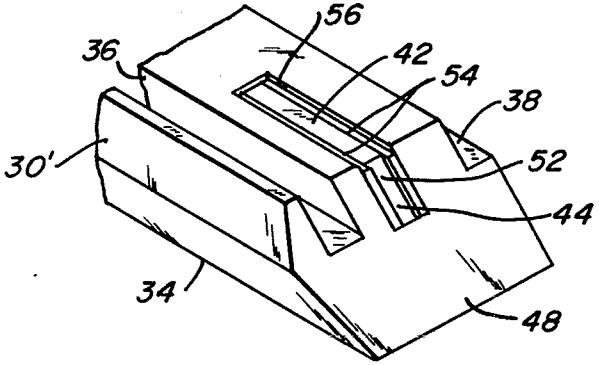
FIG. 5 is an orthographic view of an end portion of the pivotal frame member illustrated in FIGS. 2 and 4 but which illustrates therein an alternative method of carrying the magnetic latch means.
Figure 6:
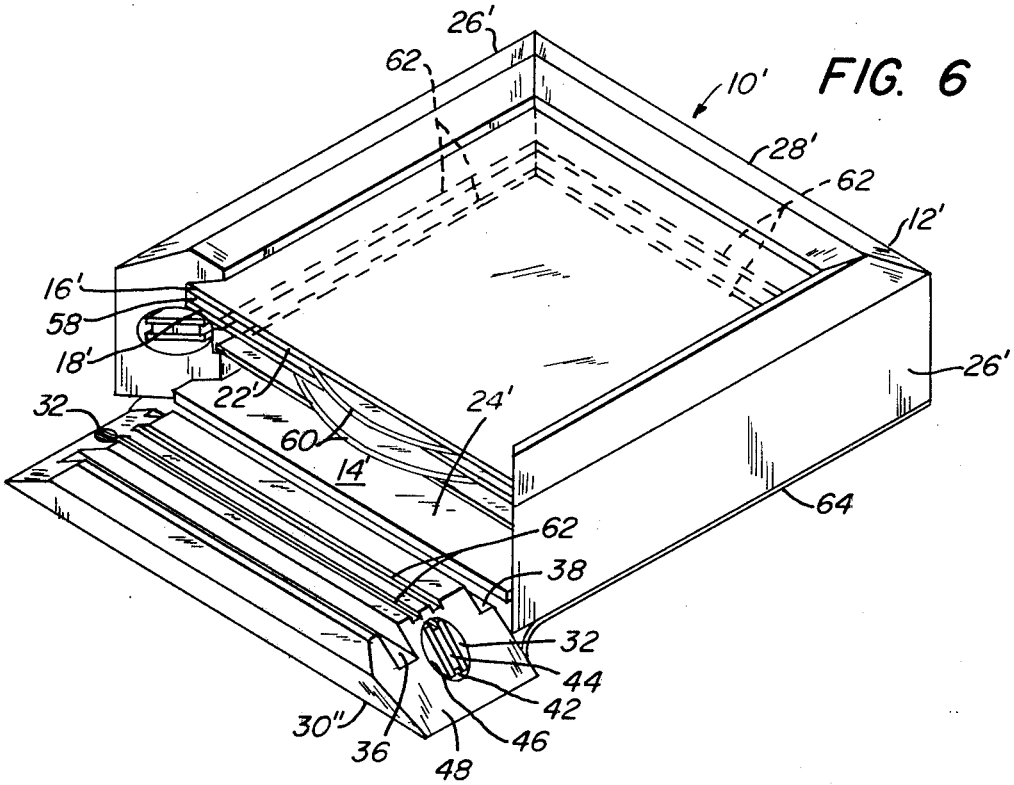
FIG. 6 is an orthographic plan view of another form of a storage and security frame assembly of the present invention which includes a multi-slotted interior and is of the type which may be utilized for record album display and storage.
Figure 7:
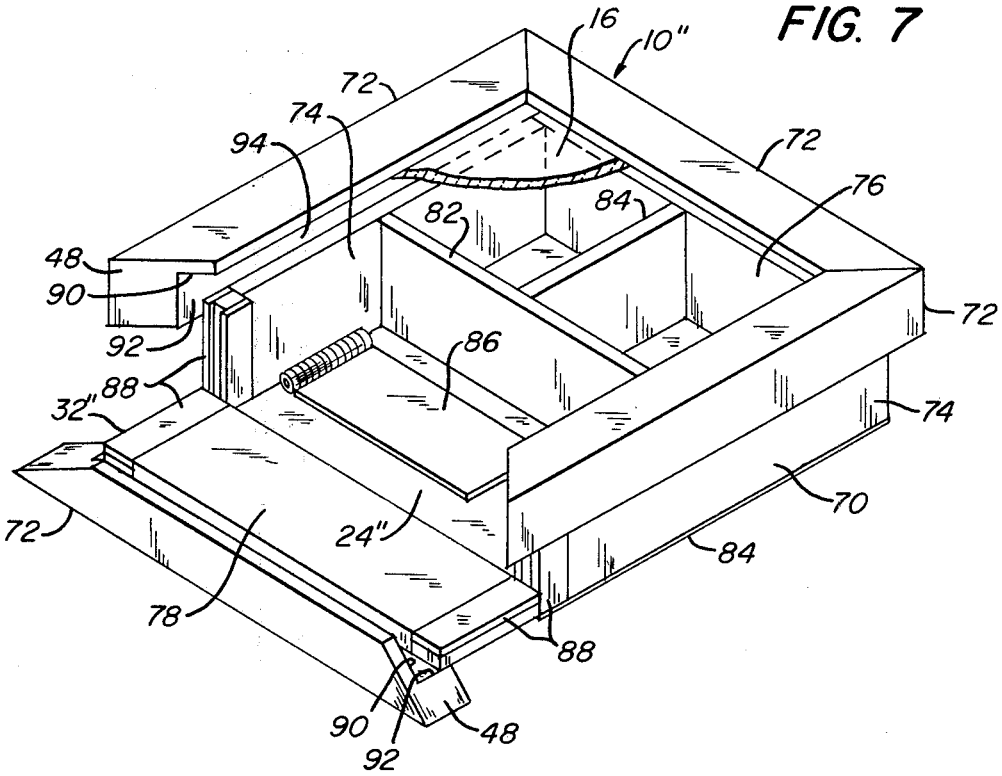
FIG. 7 is an orthographic view, partially exploded, of yet another embodiment of a storage and security frame assembly of the present invention and which is of a form to provide retrofit applications with existing types of picture frame moldings.

FIGS. 5, 6 and 7 illustrate variations to the embodiment described hereinabove with respect to FIGS. 1 through 4. Accordingly, for purposes of the description hereinafter, like elements will be identified with identical numerals and similar elements will be identified with identical numerals primed.

FIG. 5 illustrates an end portion of a pivotal side member 30' which is identical in all respects to the side member 30 discussed hereinabove with the only distinction therebetween being that the latch portions 42 are press fitted into an inwardly open end groove 56 rather than into a bore 46. This slot retention arrangement does not utilize as much vertical space as a bore reception arrangement and is of particular significance where it is desired to include a plurality of vertically spaced supporting grooves 56 in the inner periphery of the frame members. It is to be understood that a corresponding groove 56 may additionally be formed in the long side members 26 rather than including a bore 46 therewithin.

FIG. 6 illustrates a storage and security frame assembly 10' which is similar to assembly 10 discussed hereinabove with the primary distinction therebetween being that assembly 10' is structured in a generally square configuration to receive a record album 58 in the upper peripheral grooves 36' rather than an artwork 20. A record 60 may be stored within the album 58 and, if desired, a plurality of transversely aligned vertically spaced peripheral grooves 62 may be provided in the inner periphery of members 26', 28' and 30'' to store additional records 60 within the storage chamber 24'. Storage of records 60 in this fashion will prevent scratching of the surfaces thereof which often occurs if the records engage each other. Assembly 10' additionally includes a continuous flexible backing 64 suitably secured to the entire bottom of frame assembly 10'. With the usage of a backing 64, the ribbon hinge 40 need not necessarily be included for the flexibility of backing 64 is sufficient to permit the pivotal movement of member 30''. A still further feature permitted by the inclusion of the continuous backing 64 is that the frame backing member 14' need no longer be fixed into position but rather may be releasably and captively retained within the rabbet grooves 38. With this in mind, a record album 58 may be substituted for backing member 14' thus providing still additional storage area within the storage chamber 24'.

FIG. 7 illustrates a storage and security frame assembly 10'' of the present invention wherein a retrofit assembly 70 thereof is structured and dimensioned to carry standard mass produced picture frame molding 72 to form the assembly 10''.

Retrofit assembly 70 includes a generally rectangular frame subassembly 12'' consisting of long side members 74, a stationary short side member 76 and a pivotal short side member 78. The side members 74, 76 and 78 all have a generally upwardly extending rectangular configuraion. In final assembly, side members 74 and 76 are rigidly secured to each other adjacent the respective axial ends thereof. As shown, a compartment dividing strip 80 extends transversely between the spaced long side members 74 and has the axial ends thereof secured to inner peripheral portions of side members 74 intermediate the respective axial ends thereof. A further compartment dividing strip 82 extends longitudinally between strip 80 and side member 76 to thus divide the storage chamber 24'' into still further compartments. In addition to compartmentalizing the chamber 24'', the strips 80 and 82 add transverse rigidity to the retrofit assembly 70. A flexible backing 84 covers the entire bottom of sub-assembly 12'' and also provides the requisite flexiblity and support for the pivoting of side member 78 into the open and closed position thereof. Backing 84 is secured to the bottom surfaces of subassembly 12'' in any suitable manner; for example, by gluing. It is to be noted that unlike subassemblies 12 and 12', the subassembly 12'' as illustrated does not include a rigid frame backing member such as member 14.

As illustrated, a spring clip retaining means 86 is suitably rigidly secured to an upwardly facing portion of backing 84. Retaining means 86 is operative to biasly retain an object placed in storage chamber 24'' and thus prevent such object from sliding within chamber 24''.

Retrofit assembly 70 includes suitable magnetic latch means 32'' which are operative to magnetically retain side member 78 into the closed position thereof. As illustrated, magnetic latch means 32'' include vertically extending latch portions 88 which are suitably secured to members 74 and 78 at respective axial ends thereof. With a construction of retrofit assembly 70 as described hereinabove, the downwardly facing surfaces 90 of the rabbet grooves 92 of the standard picture frame molding 72 are spaced upwardly from the upper end of the side members 74, 76 and 78 a sufficient amount that the uppermost surfaces of such side members, in conjuction with the adjacent surfaces of the rabbet grooves 92 form a continuously extending groove-like configuration 94 which is dimensioned to receive the display assembly 22 therewithin. A lower vertical portion of the rabbet grooves 92 are secured, such as by gluing or the like, to an adjacent outer peripheral portion of the side members 74, 76 and 78.

Thus, with such an arrangement, the standard picture frame molding 72 completes the storage and security frame assembly 10'' and the configuration and location thereof obviates the necessity of forming an upper decorative molding portion 34 and an upper groove 36. Furthermore, the utilization of a retrofit assembly 70 permits taking advantage of the ready availability of significant quantities and configurations of relatively inexpensive commercially available picture frame molding to thus convert such standard molding into a storage and security frame assembly 10'' of the present invention.

The embodiments described hereinabove are merely preferred arrangements of storage and security frame assemblies constructed in accordance with the principles of the present invention. Accordingly, it is to be understood that various modifications can be made by those skilled in the art to the embodiments described hereinabove, without departing from the scope of the invention which is only defined by the scope of the claims set forth hereinafter. For example: identical or alternative configurations of retaining means 86 may be included within any of the storage chambers; retrofit assembly 10'' can be provided with a rigid frame backing member such as member 14 if desired; the side members 72, 74 and 76 may be made thicker if desired, thus enabling them to be mitered at the end thereof and also having the requisite thickness to receive mitered magnetic latch means 32 therewithin; the display window 16 and backing member 18 need not necessarily be included; the storage and security frame assembly could be arranged for a shadowbox effect, if desired (i.e. in assembly 10 only the glass would be received within the upper groove 36 and the artwork 20 would be positioned on the upwardly facing surface of frame backing member 14); and the like.

What is claimed is:

1. A storage and security frame assembly, comprising:

a plurality of elongated frame side members having the adjacent axial ends thereof in abutting relationship to form a closed polygonal frame assembly; a generally planar bottom member carried by said polygonal frame assembly adjacent the lower end thereof; a storage chamber generally defined by the enclosed volume intermediate the inner periphery of said frame assembly; at least one of said side members being selectively pivotal about a lower longitudinally extending pivot axis into a closed position to form said closed polygonal frame assembly and into an open position to provide access to said chamber; the others of said side members being rigidly secured together at said adjacent axial ends thereof; and magnetic latch means including elongated latch portions thereof carried adjacent axial end portions of said one of said side members and having other latch portions thereof carried adjacent axial end portions of the ones of said others of said side members which are adjacent said one of said side members, said latch means being operative to magnetically maintain said closed position until the magnetic bias thereof is selectively overcome and said one of said side members is pivoted into said open position.

2. A storage and security frame assembly as specified in claim 1 additionally including an upper generally planar member vertically spaced from said lower member and supported by said polygonal frame assembly adjacent the upper end thereof.

3. A storage and security frame assembly as specified in claim 2 wherein all of said adjacent axial ends are formed in a miter and, when in abutting relationship, said adjacent axial ends form miter joints.

4. A storage and security frame assembly as specified in claim 3 wherein each of said latch portions have an axial end thereof formed in a miter equivalent to the miter of the respective side members in which they are carried.

5. A storage and security frame assembly as specified in claim 4 wherein when said latch portions are supported by said respective side members, the miter surfaces of said latch portions lay, substantially, in a common plane with the miter surfaces of said respective side members in a manner that sait latch portions form a miter joint coinciding with the miter joint of the adjacent respective side members, when said one of said side members is in said closed position.

6. A storage and security frame assembly as specified in claim 5 wherein the outer periphery of the miter surface of said latch portions are contained within the respective miter surface of said respective side members.

7. A storage and security frame assembly as specified in claim 6 wherein the longitudinal axes of said latch portions and said respective side members are substantially parallel and the longitudinal axes of said latch portions are spaced upwardly, with respect to said bottom member, at least $\frac{1}{3}$ of the vertical spacing between said top and bottom members.

8. A storage and security frame assembly as specified in claim 7 additionally including longitudinally extending blind bores having the open ends thereof at said respective miter surfaces of said respective side members and said latch portions are longitudinally received within respective ones of said bores for the supporting thereof by said respective side members.

9. A storage and security frame assembly as specified in claim 6 including four of said side members and all of said miters are 45 degrees.

10. A storage and security frame assembly as specified in claim 9 including supporting means which support said upper member and allow the withdrawal of said upper member from said chamber when said one of said side members is in the open position thereof.

11. A storage and security frame assembly as specified in claim 10 wherein said supporting means comprises an inwardly open slot extending continuously along an inner peripheral portion of each of said side members, said slots being transversely coplanar and each of said slots supporting an adjacent edge portion of said upper member.

12. A storage and security frame assembly as specified in claim 11 wherein each of said side members includes a continuous longitudinally extending downwardly facing rabbet groove therein and said bottom member is received within said rabbet groove.

13. A storage and security frame assembly as specified in claim 2 including pivot means adjacent the bottom surface of said one of said side members which is operative to permit such pivotal movement of said one of said members while simultaneously supporting said one of said members with respect to said others of said members.

14. A storage and security frame assembly as specified in claim 11 additionally including other inwardly open slots extending continuously along another inner peripheral portion of each of said side members for receiving adjacent edge portions of other planar members therewithin, said another inner peripheral portion being spaced downwardly from said first mentioned peripheral portion and upwardly from said bottom member.

15. A storage and security frame assembly as specified in claim 1 additionally including longitudinally extending frame molding members, each of said molding members having continuous longitudinally extending inwardly facing rabbet grooves therein having downwardly and inwardly facing groove surfaces, each of said molding members being supported by respective side members in a manner that a lower portion of each of said inwardly facing surfaces engage adjacent upper outer peripheral surfaces of said side members and said downwardly facing surfaces are spaced upwardly from the respective uppermost surfaces of said side members.

* * * * *